US009918513B2

(12) United States Patent
Vakili

(10) Patent No.: US 9,918,513 B2
(45) Date of Patent: Mar. 20, 2018

(54) REVERSIBLE PROTECTIVE FOOTWEAR

(71) Applicant: Shahab Vakili, Rancho Santa Margarita, CA (US)

(72) Inventor: Shahab Vakili, Rancho Santa Margarita, CA (US)

( * ) Notice: Subject to any disclaimer, the term of this patent is extended or adjusted under 35 U.S.C. 154(b) by 561 days.

(21) Appl. No.: 14/205,981

(22) Filed: Mar. 12, 2014

(65) Prior Publication Data

US 2014/0259740 A1 Sep. 18, 2014

Related U.S. Application Data

(60) Provisional application No. 61/779,172, filed on Mar. 13, 2013.

(51) Int. Cl.

| | |
|---|---|
| ***A43B 3/00*** | (2006.01) |
| ***A43B 3/12*** | (2006.01) |
| ***A43B 1/00*** | (2006.01) |
| ***A43B 3/10*** | (2006.01) |
| ***A43B 5/00*** | (2006.01) |

(52) U.S. Cl.

CPC ..... *A43B 3/124* (2013.01); *A43B 1/00* (2013.01); *A43B 3/0036* (2013.01); *A43B 3/106* (2013.01); *A43B 5/00* (2013.01)

(58) Field of Classification Search

CPC ..... A43B 3/124; A43B 3/0036; A43B 3/126; A43B 3/12; A43B 3/106; A43B 3/105; A43B 3/10; A43B 1/00; A43C 15/02; A43C 15/04; A61F 13/065; A61F 13/068; A61F 13/064; A61F 5/0111

USPC ..... 36/11.5, 8.1, 7.4, 7.2, 7.7

See application file for complete search history.

(56) References Cited

U.S. PATENT DOCUMENTS

| | | | |
|---|---|---|---|
| 900,881 | A | 10/1908 | Parker |
| 1,124,596 | A | 1/1915 | Dalpe |
| 1,788,852 | A | 1/1931 | Arthur |
| 1,810,514 | A | 6/1931 | Bennett |
| 1,930,188 | A | 10/1933 | Arthur |
| 2,075,229 | A | 3/1937 | Rose |
| 2,119,233 | A | 5/1938 | Judkins |
| 2,237,652 | A | 4/1941 | Capezio |

(Continued)

OTHER PUBLICATIONS

PCT Invitation to Pay Additional Search Fees for PCT/US14/23093, dated Sep. 2, 2014 in 3 pages.

(Continued)

*Primary Examiner* — Ted Kavanaugh

(74) *Attorney, Agent, or Firm* — Knobbe Martens Olson & Bear LLP

(57) ABSTRACT

This disclosure relates in certain embodiments to protective footwear comprising a flexible strap that can be wrapped around a bare foot in order to provide protection and traction to the ball and heel of the foot. The footwear can provide protection from rough or hot surfaces, for example swimming pool decks or hot sand at the beach. The footwear can also provide traction for the user on wet or slippery surfaces. The footwear is designed to minimally cover the foot, giving the user a "barefoot" feeling, while still providing protection and traction to the pressure points (e.g., ball and heel) of the foot. The footwear can be securely fastened to the user's foot such that it does not fall off during routine physical activity (e.g., swimming, walking, etc.).

20 Claims, 7 Drawing Sheets

(56) References Cited

U.S. PATENT DOCUMENTS 2,252,315 A 8/1941 Doree
2,358,966 A 9/1944 Einstoss
2,486,886 A 11/1947 Saukkonen
2,513,005 A 6/1950 Crawford
2,541,738 A 2/1951 Bassichis
2,708,930 A 5/1955 Lowman
3,380,178 A 4/1968 Haig
3,603,006 A 9/1971 Davenport et al.
3,676,940 A 7/1972 Shively
3,683,519 A 8/1972 Creamer
4,069,599 A * 1/1978 Alegria ..... A43B 3/20 36/106
4,085,745 A 8/1978 Alenares
4,251,932 A 2/1981 Love
4,271,605 A 6/1981 Raczka
4,372,056 A 2/1983 Benaquista
4,476,858 A 10/1984 Curtis
4,495,715 A 1/1985 Fredrickson et al.
4,651,354 A 3/1987 Petrey
4,751,784 A * 6/1988 Petker ..... A43B 3/106 36/11.5
4,976,050 A 12/1990 Houghteling
5,205,071 A 4/1993 Hergenroeder
5,257,969 A 11/1993 Mance
5,282,782 A 2/1994 Kasahara
5,285,939 A 2/1994 Hogan
5,460,601 A 10/1995 Shannahan
5,554,107 A 9/1996 Shannahan
5,689,901 A 11/1997 Bell et al.
D390,343 S 2/1998 Chen
5,718,673 A 2/1998 Shipstead
5,737,853 A 4/1998 Smejkal
5,755,679 A * 5/1998 Selner ..... A61F 5/0111 602/27
5,865,779 A 2/1999 Gleason
5,867,838 A 2/1999 Corry
5,960,565 A 10/1999 Lochbaum
6,018,888 A 2/2000 Wilkenfeld et al.
6,035,554 A 3/2000 Duncan
6,454,733 B1 9/2002 Krusenklaus
6,526,676 B1 3/2003 Ledergerber
6,640,465 B1 11/2003 Burgess
D494,746 S 8/2004 Gomez-Tagle-Mendez
6,800,063 B2 10/2004 Iwata
D499,807 S 12/2004 Stauffer
6,874,253 B2 4/2005 Hollis-Lorent
D517,784 S 3/2006 Wilkenfeld et al.
D520,217 S 5/2006 Kim
7,051,457 B1 5/2006 Huggins et al.
7,080,466 B2 * 7/2006 Fischbein ..... A43B 3/106 36/50.1
7,082,703 B2 8/2006 Greene et al.
D535,461 S 1/2007 Wilkenfeld et al.
7,166,083 B2 1/2007 Bledsoe
D538,527 S 3/2007 Ransan
D551,430 S 9/2007 Wilkenfeld et al.
D558,957 S 1/2008 Wilkenfeld et al.
D559,504 S 1/2008 Wilkenfeld et al.
7,346,936 B2 3/2008 Vargas et al.
D577,829 S 9/2008 Reinhardt et al.
7,536,808 B2 5/2009 Myers et al.
7,673,396 B2 3/2010 Terlizzi et al.
D613,909 S 4/2010 Oban
7,739,810 B2 6/2010 Luedecke et al.
7,847,143 B2 12/2010 Moramarco et al.
7,856,739 B2 12/2010 Terlizzi et al.
D633,657 S 3/2011 Oban
D634,103 S 3/2011 Nataadiningrat
7,966,747 B2 6/2011 Wilkenfeld et al.
7,972,290 B1 7/2011 Chisholm
8,112,910 B2 2/2012 Herber
D655,908 S 3/2012 Eakin
D673,281 S 12/2012 Rust Huthmaker
D673,686 S 1/2013 Rust Huthmaker
2004/0025372 A1 2/2004 Watanabe
2004/0261289 A1 12/2004 Lindsay
2005/0096577 A1 5/2005 Sykes et al.
2006/0107444 A1 5/2006 Huggins
2006/0143944 A1 7/2006 Collins
2006/0179549 A1 8/2006 Huggins et al.
2006/0196078 A1 9/2006 Terlizzi et al.
2006/0288609 A1 12/2006 Wilkenfeld et al.
2007/0006486 A1 1/2007 Wilkenfeld et al.
2008/0022555 A1 1/2008 Mor et al.
2008/0110045 A1 5/2008 Terlizzi et al.
2008/0250669 A1 * 10/2008 Hallivis ..... A43B 7/00 36/96
2008/0255490 A1 10/2008 Daley
2009/0100715 A1 4/2009 Broadley
2009/0192428 A1 * 7/2009 DeBoer ..... A61F 5/0111 602/27
2009/0270784 A1 10/2009 Arensdorf
2010/0088804 A1 4/2010 Crosby
2010/0251563 A1 * 10/2010 Oliveira ..... A43B 1/0081 36/11.5
2011/0197343 A1 8/2011 Stevenson
2012/0083722 A1 4/2012 Franke et al.
2012/0215147 A1 8/2012 Lunnon
2012/0232453 A1 9/2012 Cropper et al.

OTHER PUBLICATIONS

International Search Report and Written Opinion for PCT/US14/23093, dated Nov. 19, 2014, in 18 pages.

* cited by examiner

REVERSIBLE PROTECTIVE FOOTWEAR

CROSS-REFERENCE TO RELATED APPLICATIONS

This application claims priority to U.S. Provisional Application No. 61/779,172 filed Mar. 13, 2013, which is hereby expressly incorporated in its entirety by reference herein and should be considered a part of this specification.

SUMMARY

This disclosure relates in certain embodiments to protective footwear comprising a single-molded strap that can be wrapped around a bare foot in order to provide protection and traction to the ball and heel of the foot. The footwear can provide protection from rough or hot surfaces, for example swimming pool decks or hot sand at the beach. The footwear can also provide traction for the user on wet or slippery surfaces. The footwear is designed to minimally cover the foot, giving the user a "barefoot" feeling, while still providing protection and traction to the pressure points (e.g., ball and heel) of the foot. The footwear can be securely fastened to the user's foot such that it does not fall off during routine physical activity (e.g., swimming, walking, etc.).

DETAILED DESCRIPTION

In a preferred embodiment, the footwear is designed to cover just the ball and heel on the underside of the foot, with the strap 100 wrapping around portions of the sides and top of foot for purposes of securing the footwear to the user's foot. Specifically, the toes and the arch of the foot can be left uncovered, helping to give the user the feeling of being barefoot. Additionally, the open-toe design gives the user additional stability and traction compared to closed-toe footwear. In some embodiments, the footwear only covers a small portion of the underside of the foot, e.g., between 5 and 40% of the underside of the foot.

The single-piece strap 100 is designed to be substantially flat when not in use. The flat design can be reversible, with the same material or surface on both sides, allowing a single strap 100 to be worn on either the left or right foot. The strap 100 can be made from a flexible, resilient and/or elastic material, for example, silicone. In some embodiments, the silicone can be about 5 durometer silicone. The resilient material allows the strap 100 to stretch around the foot to provide a tight or "snug" fit. The resilient material also provides cushioning for the portions of the underside of the foot covered by the strap 100 (e.g., the ball and heel of the foot). The generally flat, compressible nature of the strap 100 allows for it to be easily transported and stored. In some embodiments, the footwear can also be intended to be single-use or disposable (e.g., after a few days of use).

Figure 1:
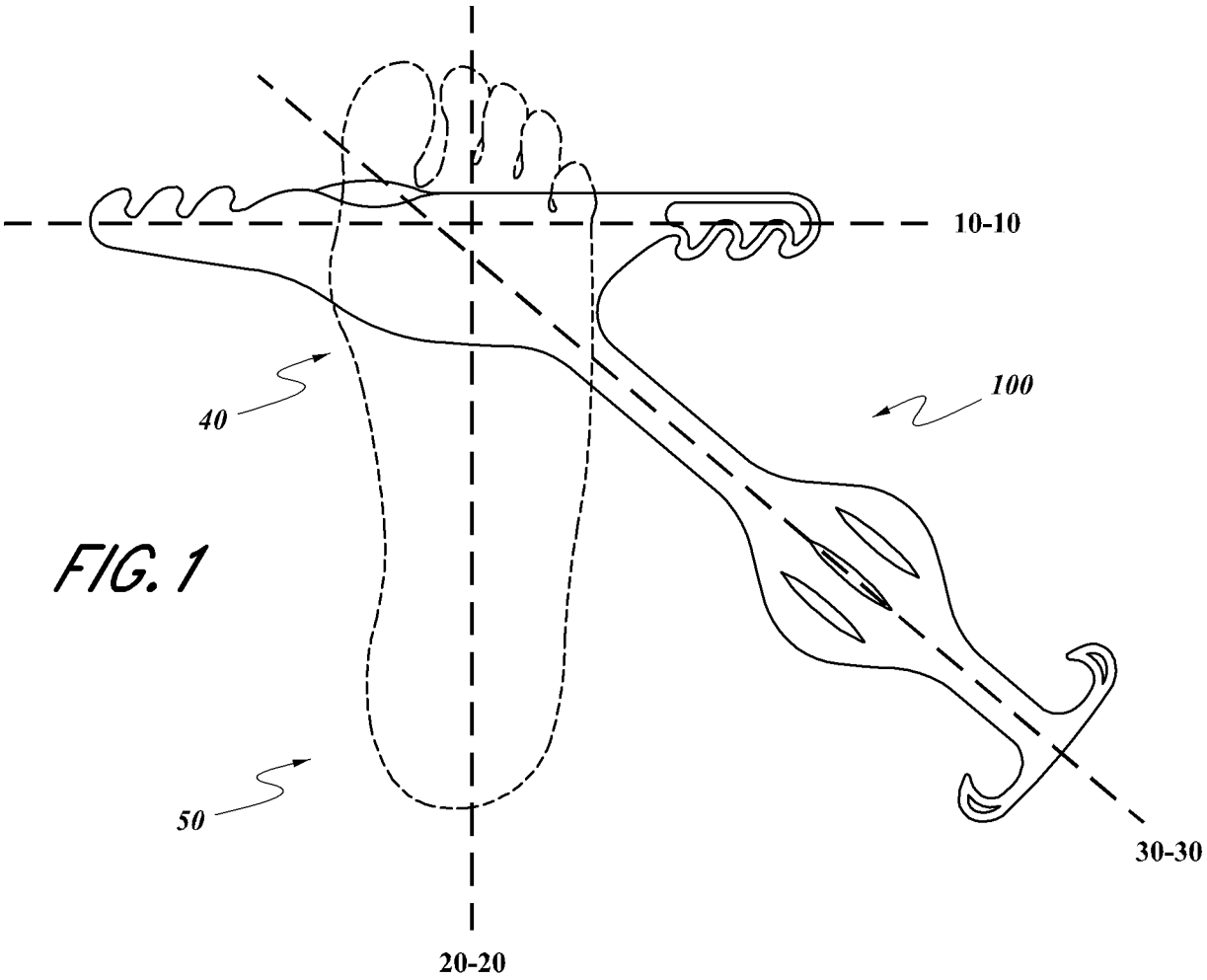
FIG. 1 is a top profile view of one embodiment of the footwear.
Figure 2:
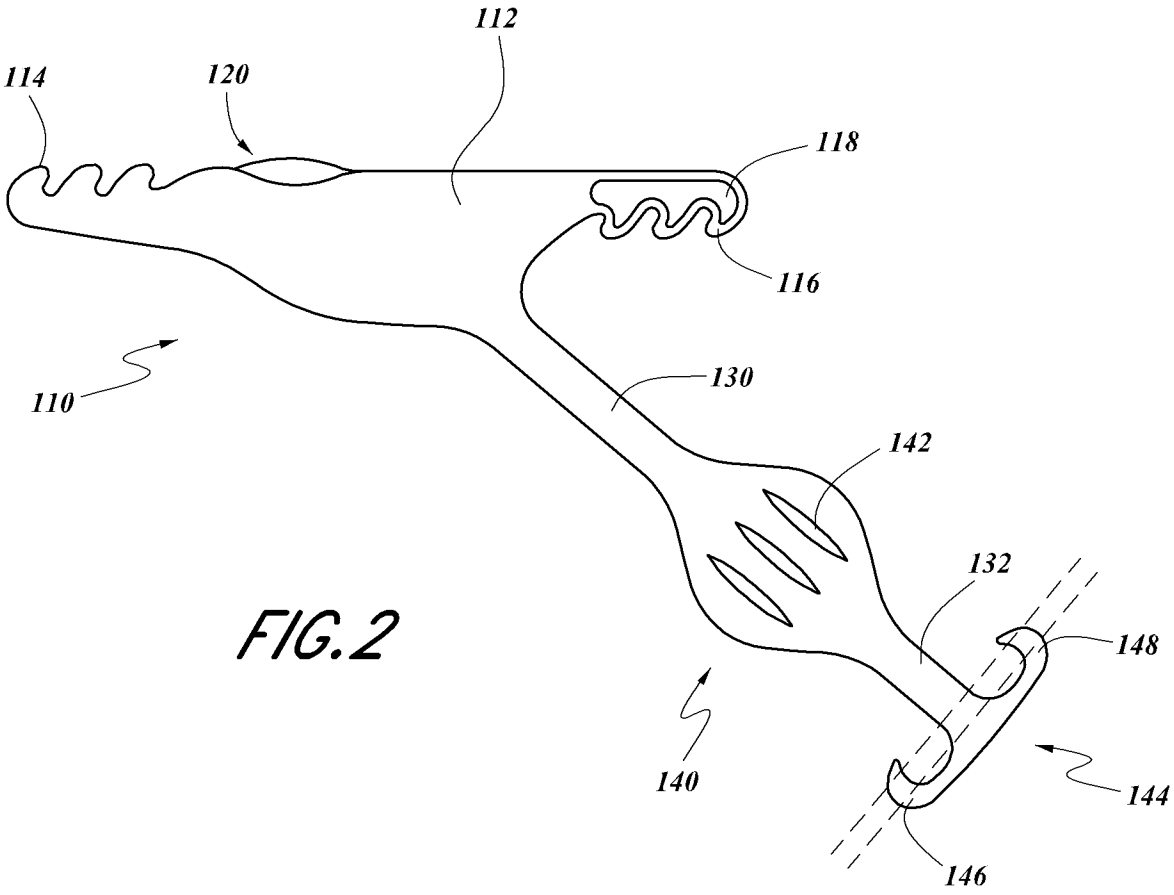
FIG. 2 is a top profile view of one embodiment of the footwear.
Figure 3B:
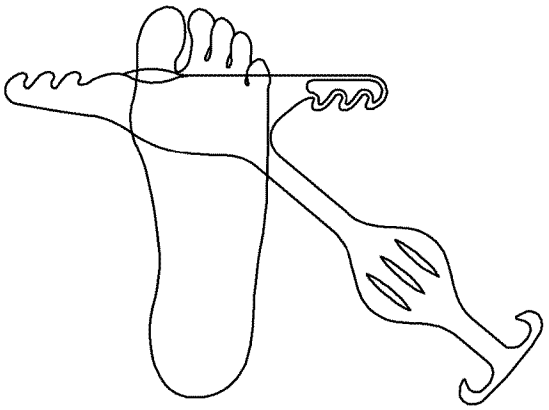
FIGS. 3A-3E are illustrations of progressive stages of wrapping one embodiment of the strap onto a foot.
Figure 3A:
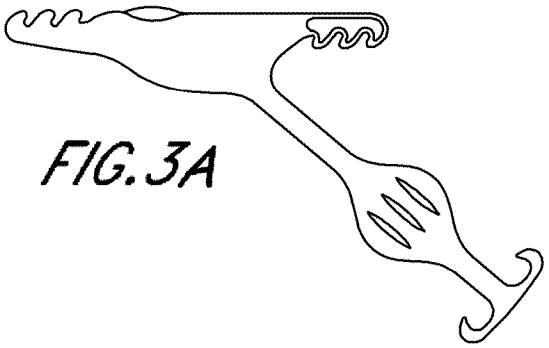
Figure 3C:
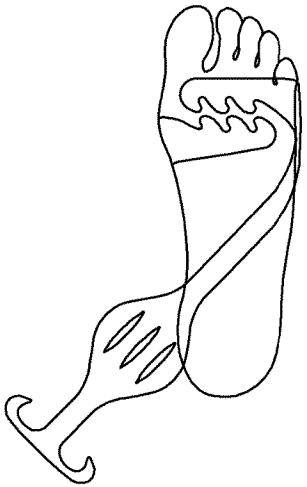
Figure 3D:
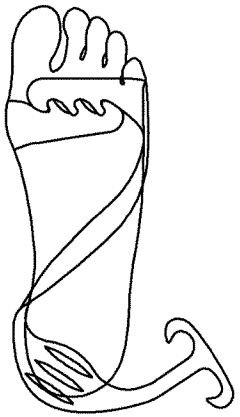
Figure 3E:
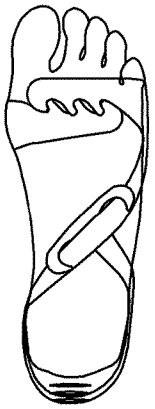

A top profile view of the footwear is shown in FIGS. 1 and 2, along with a generic outline of a human foot in FIG. 1 for purposes of demonstrating alignment. As shown in FIGS. 1 and 2 above, the strap 100 (which is shown in a flat configuration) comprises a forefoot portion 110 that includes a ball portion 112 and two attachment elements 114 and 116 integrally formed off the medial and lateral sides, respectively, of the ball portion 112. The ball portion 112 can generally have the shape of the underside of a human foot in the metatarsal region around or near the ball of the foot. This shape can be, for example, rectangular with rounded corners, or it can be generally oval or oblong. The attachment elements 114 and 116 can project outward from opposite sides of the ball portion 112 along a forefoot axis 10-10 generally perpendicular to the longitudinal axis 20-20 of the human foot defined between the anterior 40 and posterior 50 portions of the human foot. The attachment elements 114 and 116 can stretch and/or wrap around the top of the foot generally above the ball portion and removably engage one another, securing the forefoot portion 110 to the user's foot. In one embodiment, the attachment elements 114 and 116 comprise a series of complementary interlocking hooks or teeth capable of removably engaging each other, as shown in the figures. In some embodiments, the attachment elements 114 and 116 may further comprise an attachment insert 118 that can be made of a stiffer or less flexible material compared to the rest of the strap in order to facilitate the engagement between the complementary attachment elements 114 and 116. For example, in some embodiments, the attachment insert 118 can be made of about 80 durometer silicone. In one embodiment, the attachment elements 114 and 116 can comprise one or more flexible teeth (on one element) able to removably engage one or more corresponding openings (on the second element). In other embodiments, the attachment elements can comprise any complementary attachment mechanism known in the art, including buckles, Velcro, snap fasteners, laces, etc. In some embodiments, the forefoot portion 110 can have one or more openings 120 capable of engaging one or more toes (e.g., the big toe) to further secure the forefoot portion 110 to the foot.

The strap 100 of the footwear further comprises a first connecting strip 130 that is integrally formed off of the posterior side of the forefoot portion 110 of the strap. The first connecting strip 130 can be formed at an angle relative to the forefoot axis 10-10 that allows the first connecting strip 130 to stretch and/or wrap over the top of the user's foot in a direction generally from the anterior lateral portion of the foot to the posterior medial portion of the foot. The angle of departure of the first connecting strip from the forefoot region defines the strip axis 30-30 (see FIG. 1). The first connecting strip 130 can be generally straight along the strip axis 30-30. Preferably, the first connecting strip 130 is relatively thin to reduce overall weight of the footwear, increase flexibility of the strip, and reduce coverage of the foot by the footwear (e.g., to provide the user with a barefoot feeling). The first connecting strip 130 connects the forefoot portion 110 of the strap 100 to a heel portion of the strap 140.

The heel portion 140 is designed to cover the bottom of the heel, and in some embodiments, to "cup" the heel while the footwear is worn to the user. The heel portion 140 can have a generally rounded or oval shape. The heel portion 140 is also connected to a second connecting strip 132 formed integrally with the heel portion 140, with the first and second connecting strips 130 and 132 integrally attached to opposite sides of the heel portion 140 along the strip axis 30-30. The heel portion 140 can further comprise one or more expansion slits or ribs 142 located within the body of the heel portion 140 to allow the heel portion 140 to stretch around the user's heel. The expansion slits 142 can be generally oriented parallel to the strip axis 30-30 in the direction from the first connecting strip 130 to the second connecting strip 132.

The second connecting strip 132 is integrally formed off the heel portion 140 opposite the first connecting strip 130. The second connecting strip 132 can be generally straight along the strip axis 30-30. Preferably, like the first connecting strip 130, the second connecting strip 132 should have a relatively thin width, as shown in the figures, compared to the forefoot 110 and heel portions 140 of the strap 100. The end of the second connecting strip 132 opposite the heel member 140 is integrally formed with a second attachment feature 144. The second attachment 144 feature is capable of removably engaging the first connecting strip 130 when the first connecting strip 130 is stretched and/or wrapped across the top of the user's foot, thereby securing the heel portion 140 to the user's heel with the tension created by the first and second connecting strips 130 and 132.

In one embodiment shown above, the second attachment feature 144 comprises two hooks 146 and 148 that project perpendicularly to the strip axis 30-30 from the second connecting strip 132. The hooks 146 and 148 and second connecting strip 132 can removably engage the first connecting strip 130 while the first connecting strip 130 is wrapped across the top of the user's foot. In other embodiments, the second attachment feature 144 can be any attachment mechanism known in the art, including laces, Velcro, snap fasteners, etc.

Figure 4B:
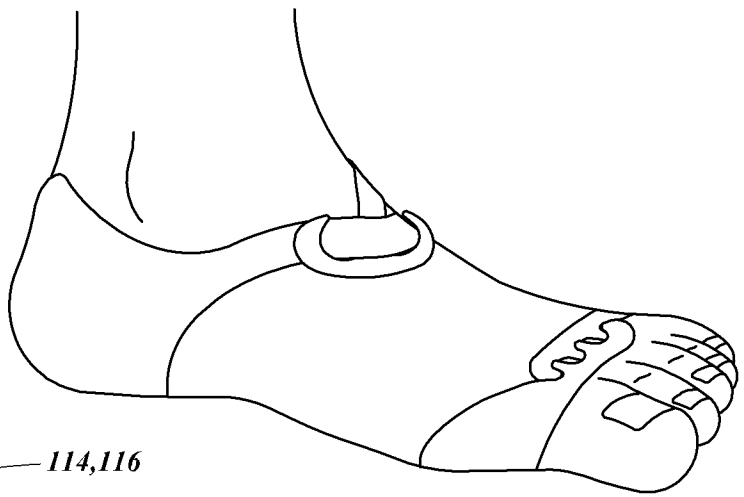
FIGS. 4A-4B are illustrations of one embodiment of the footwear worn on a foot.
Figure 4A:
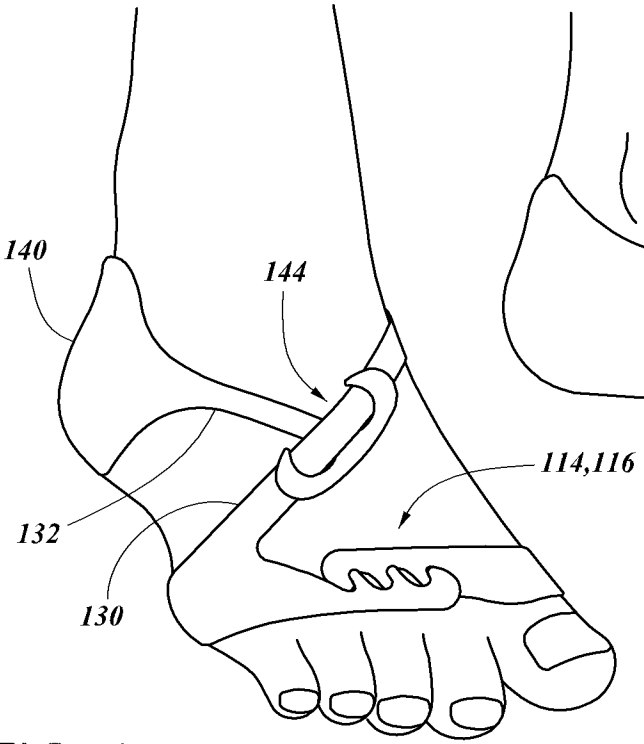
Figure 5:
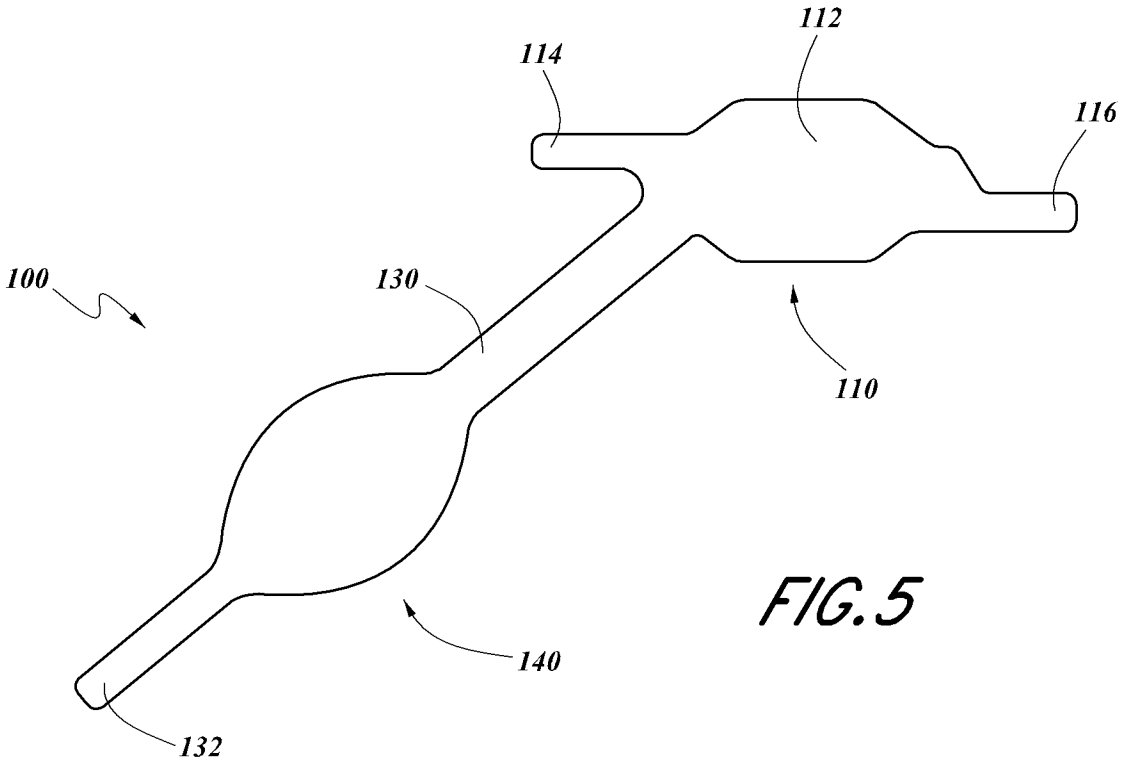
FIG. 5 is a top profile view one embodiment of the footwear.
Figure 6:
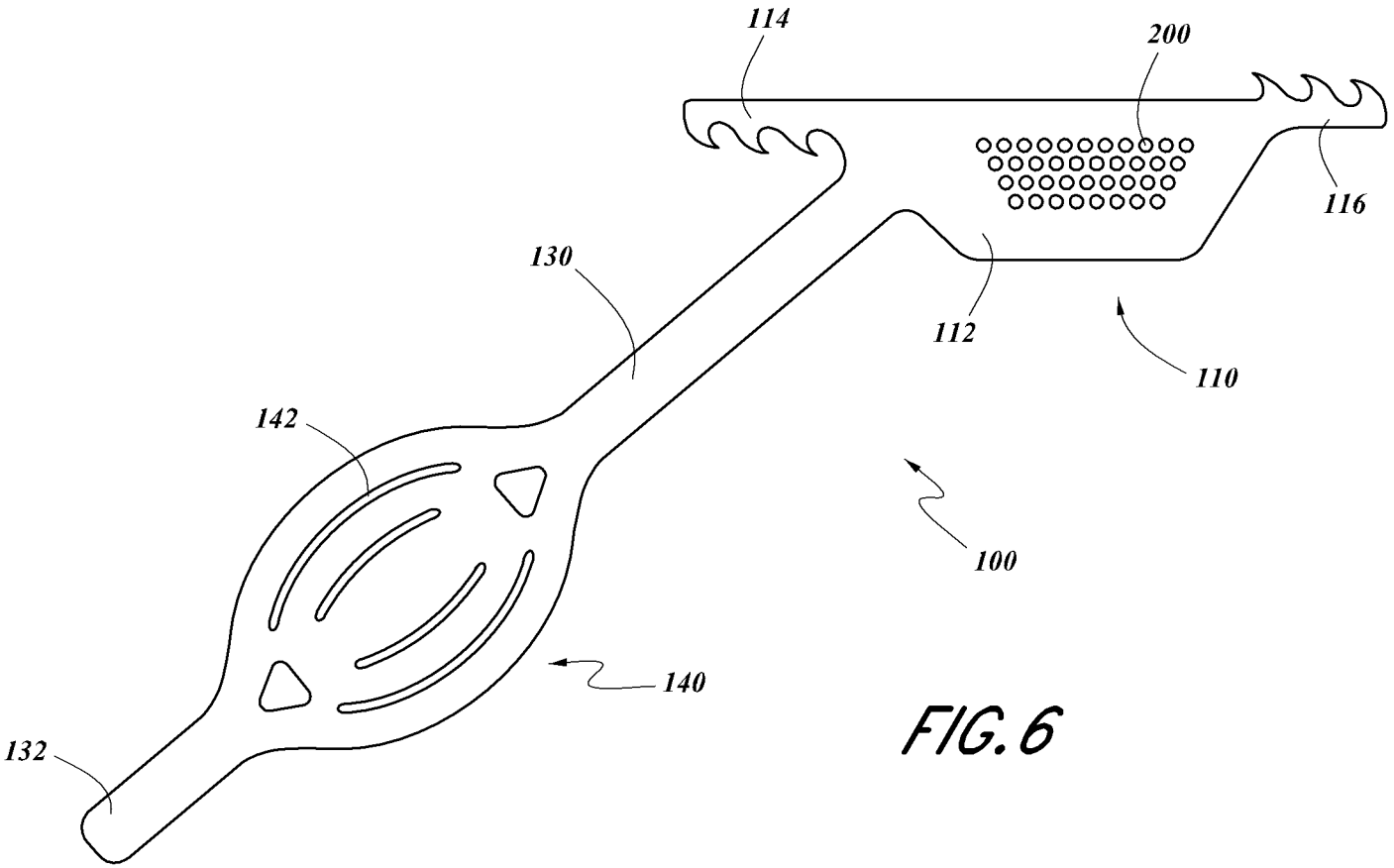
FIG. 6 is a top profile view one embodiment of the footwear.
Figure 7:
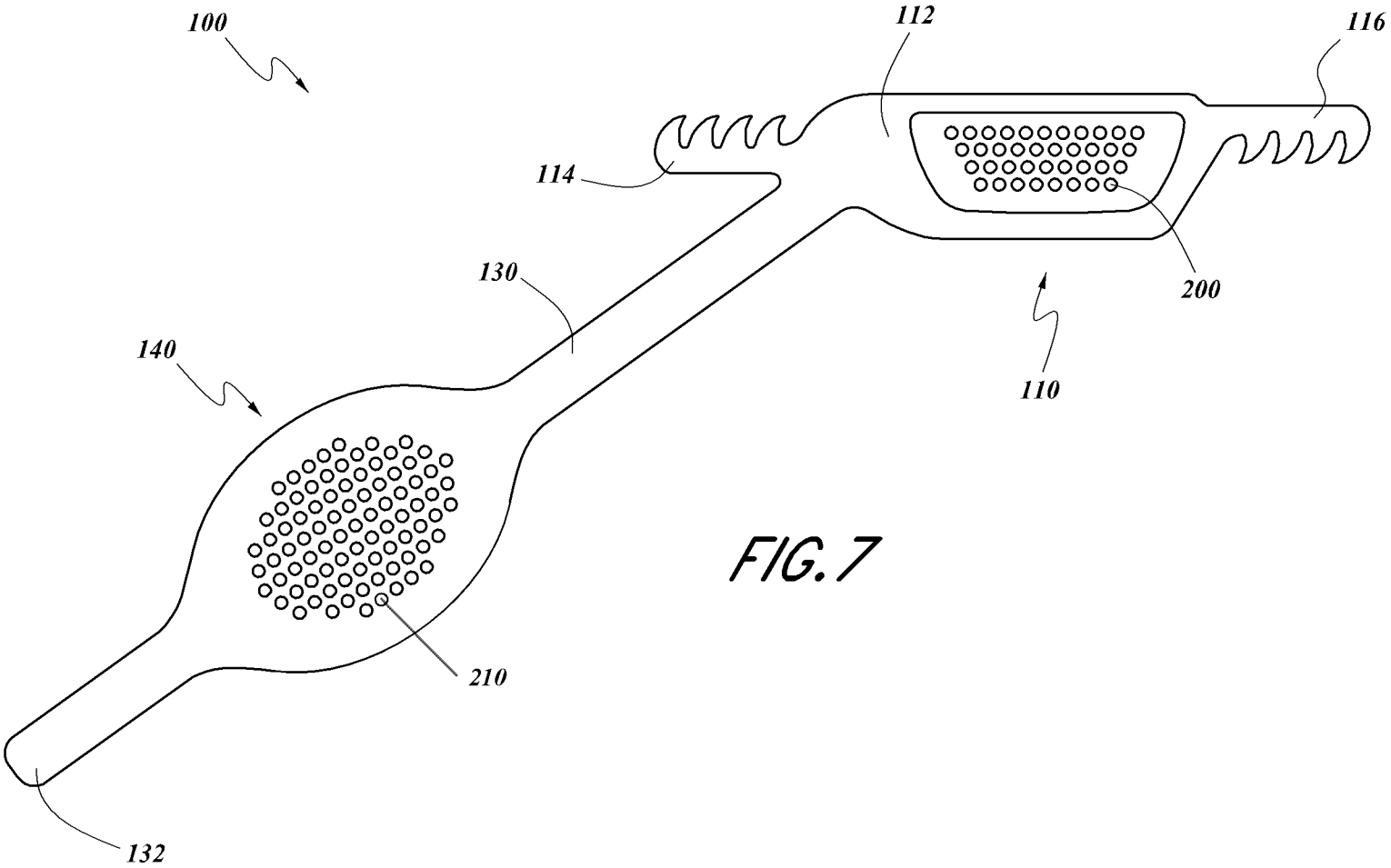
FIG. 7 is a top profile view one embodiment of the footwear.

As shown in FIGS. 3 and 4 below, a user wears the footwear/strap 100 by stretching and/or wrapping the strap 100 around the foot. The user can place the ball portion 112 under the ball of the user's foot, with the attachment elements 114 and 116 extending out from the medial and lateral sides of the ball portion 112 and the first connecting strip 130 extending out posteriorly from the lateral side of the user's foot (FIG. 3-2). The user can use the attachment elements 114 and 116 to secure the forefoot portion 110 to the user's foot by wrapping the attachment elements 114 and 116 over the top of the foot and engaging the opposite attachment elements (FIG. 3-3). Preferably, the attachment elements 114 and 116 can be stretched with an amount of tension sufficient for the forefoot 110 portion of the strap 100 to be tightly wrapped around the foot to prevent the strap from falling or sliding off, but not too tight as to be uncomfortable for the user. The user can wrap the first connecting strip 130, extending laterally out from the forefoot portion 110, over the top of the user's foot in a direction generally from the anterior lateral portion of the foot to the posterior medial portion of the foot (FIG. 3-3). Preferably, the length of the first connecting strip 130 is such that when both the forefoot 110 and heel 140 portions are probably aligned on the user's foot, the first connecting strip 130 is tensioned. The user can then place the user's heel in the heel portion of the strap 100 (FIG. 3-4). If the user desires, the user can utilize the expansion slits 142 to stretch the heel portion around the user's heel for more protective coverage of the heel. Finally, the user can wrap the second connecting strip 132 along the lateral side of the foot towards to top middle of the foot where it can intersect the first connecting strip 130 which is wrapped across the top of the foot (FIG. 3-5). The first and second connecting strips 130 and 132 can then be removably engaged using the second attachment feature 144 located at the end of the second connecting strip 132 (FIG. 3-5). Preferably, when the first and second connecting strips 130 and 132 are removably engaged using the second attachment feature 144, both the first and second connecting strips 130 and 132 should be tensioned so as to maintain a snug fit for the footwear on the user's foot.

In one embodiment, the forefoot portion 110 can have a plurality of indentations 200. In some embodiments, the indentations 200 pass through the entire thickness of the strap 100, resulting in a hole through the strap. In some embodiments, the indentations 200 only pass through a portion of the strap 100, leaving a layer or membrane on one side of the indentation or within the indentation. In some embodiments, the indentations 200 can be round. In some embodiments, the indentations 200 can be polygonal. In some embodiments, the indentations 200 allow water and/or air to pass through the strap, giving the strap a breathable feel for the user.

In one embodiment, the heel portion 140 can have a plurality of indentations 210. In some embodiments, the indentations 210 pass through the entire thickness of the strap 100, resulting in a hole through the strap. In some embodiments, the indentations 210 only pass through a portion of the strap 100, leaving a layer or membrane on one side of the indentation or within the indentation. In some embodiments, the indentations 210 can be round. In some embodiments, the indentations 210 can be polygonal. In some embodiments, the indentations 210 allow water and/or air to pass through the strap, giving the strap a breathable feel for the user.

While certain embodiments have been described, these embodiments have been presented by way of example only, and are not intended to limit the scope of protection. Indeed, the novel methods and apparatuses described herein may be embodied in a variety of other forms. Furthermore, various omissions, substitutions and changes in the form of the methods and apparatuses described herein may be made. Furthermore, the features and attributes of the specific embodiments disclosed above may be combined in different ways to form additional embodiments, all of which fall within the scope of the present disclosure.

Although the present disclosure includes certain embodiments, examples and applications, it will be understood by those skilled in the art that the present disclosure extends beyond the specifically disclosed embodiments to other alternative embodiments and/or uses and obvious modifications and equivalents thereof, including embodiments which do not provide all of the features and advantages set forth herein. Accordingly, the scope of the present disclosure is not intended to be limited by the specific disclosures of preferred embodiments herein.

What is claimed is:

1. A protective footwear comprising a single-molded strap that can be wrapped around a bare foot in order to provide protection and traction to a ball and a heel of the foot, the single-molded strap comprising:

a forefoot portion extending between a medial end and a lateral end along a forefoot axis and comprising a ball portion configured to underlie the ball of the foot;

a heel portion configured to underlie the heel of the foot;

a first connecting strip connecting the forefoot portion and the heel portion, the first connecting strip connected to a posterior side of the forefoot portion and extending at an angle to the forefoot axis in a posterior and lateral direction away from the forefoot portion to the heel portion;

a second connecting strip connecting the heel portion to a second attachment feature and extending in a posterior and lateral direction away from the heel portion, wherein the second attachment feature is configured to removably engage the first connecting strip;

wherein the single-molded strap is configured such that a bottom of an arch and bottoms of toes of the foot are not covered by the strap when the strap is wrapped around the bare foot, and wherein the heel portion of the strap underlies the heel of the foot when the strap is wrapped around the bare foot.

2. The protective footwear of claim 1, wherein the single-molded strap further comprises a first attachment element and a second attachment element at the medial and lateral ends, respectively, of the forefoot portion;

wherein the first and second attachment elements are configured to removably engage one another to facilitate securing the forefoot portion of the strap to the ball of the foot.

3. The protective footwear of claim 2, wherein the first attachment element further comprises a set of teeth configured to facilitate engagement between the first and second attachment elements.

4. The protective footwear of claim 2, further comprising one or more attachment inserts, wherein the one or more attachment inserts are configured to facilitate engagement between the first and second attachment elements.

5. The protective footwear of claim 1, wherein the single-molded strap is configured to be reversible, wherein the strap can be worn on either a left or a right foot.

6. The protective footwear of claim 1, wherein the single-molded strap comprises a flexible material.

7. The protective footwear of claim 1, wherein the single-molded strap is substantially flat.

8. A protective footwear for a foot of a user, comprising:

a single-piece strap comprising:

a forefoot portion having a ball portion located between a first attachment element at a medial side of the forefoot portion and a second attachment element at a lateral side of the forefoot portion, wherein the ball portion, the first attachment element and the second attachment element are integrally formed, and wherein the first and second attachment elements project outward from opposite sides of the ball portion along a forefoot axis, wherein:

the first and second attachment elements are configured to removably engage one another, and the ball portion of the forefoot portion of the strap is configured to secure to a ball portion of the foot with the forefoot axis being generally perpendicular to a longitudinal axis of the foot defined between anterior and posterior portions of the foot;

a heel portion configured to secure to a heel of the foot;

a first connecting strip integrally connected to the ball portion and the heel portion of the strap, wherein:

the first connecting strip is configured to connect the ball portion of the strap to the heel portion of the strap, the first connecting strip extends along a strip axis from a posterior side of the ball portion of the forefoot portion at an angle to the forefoot axis in a posterior and lateral direction, and the first connecting strip is sized and configured to wrap over a top of the user's foot in a direction generally from an anterior lateral portion of the foot to a posterior medial portion of the foot;

a second connecting strip integrally connected to the heel portion of the strap and extending along the strip axis in a posterior and lateral direction away from the heel portion; and a second attachment feature integrally formed with the second connecting strip at an end of the second connecting strip away from the heel portion, wherein the second attachment feature is configured to removably engage the first connecting strip;

wherein the strap provides protection and traction to the ball portion and a heel portion of the foot when worn by the user, and wherein the strap is configured such that a bottom of an arch and bottoms of toes of the foot are not covered by the strap and the strap underlies the heel portion of the foot when the strap is secured to the ball and heel of the foot.

9. The protective footwear of claim 8, wherein the first and second connecting strips are configured to provide tension to secure the heel portion of the strap to the heel portion of the foot when the second attachment feature is removably engaged to the first connecting strip.

10. The protective footwear of claim 8, wherein the strap is configured to be reversible, wherein the strap can be worn on either a left or a right foot.

11. The protective footwear of claim 8, wherein the forefoot portion, the first attachment element, the second attachment element, the heel portion, the first connecting strip, the second connecting strip and the second attachment feature are integrally formed from a single piece of silicone.

12. The protective footwear of claim 8, wherein the first attachment element and the second attachment element comprise interlocking hooks or teeth.

13. The protective footwear of claim 8, further comprising one or more attachment inserts, wherein the one or more attachment inserts are configured to facilitate engagement between the first and second attachment elements.

14. The protective footwear of claim 8, wherein the single-molded strap is substantially flat.

15. The protective footwear of claim 8, wherein the heel portion comprises a plurality of expansion slits or ribs.

16. The protective footwear of claim 8, wherein the forefoot portion comprises a plurality of indentations that pass partially or entirely through a thickness of the strap.

17. The protective footwear of claim 8, wherein the heel portion comprises a plurality of indentations that pass partially or entirely through a thickness of the strap.

18. The protective footwear of claim 1, wherein the heel portion comprises a plurality of expansion slits or ribs.

19. The protective footwear of claim 1, wherein the forefoot portion comprises a plurality of indentations that pass partially or entirely through a thickness of the strap.

20. The protective footwear of claim 1, wherein the heel portion comprises a plurality of indentations that pass partially or entirely through a thickness of the strap.

* * * * *